United States Patent [19]

Willmann et al.

[11] 4,063,071

[45] Dec. 13, 1977

[54] FLEXITIME RECORDER

[75] Inventors: Erich Willmann, Zell; Günter Trischler, Plochingen, both of Germany

[73] Assignee: Simplex Time Recorder Co., Gardner, Mass.

[21] Appl. No.: 676,397

[22] Filed: Apr. 12, 1976

Related U.S. Application Data

[62] Division of Ser. No. 491,068, July 23, 1974, Pat. No. 3,974,362.

[51] Int. Cl.[2] ..... G07C 1/00

[52] U.S. Cl. ..... 235/92 T; 235/92 AC; 235/92 R; 346/20

[58] Field of Search ..... 235/92 T, 92 AC; 58/24 A; 346/20

[56] References Cited

U.S. PATENT DOCUMENTS

| | | | |
|---|---|---|---|
| 3,221,150 | 11/1965 | Goodwin | 235/92 AC |
| 3,593,008 | 7/1971 | DeWitt et al. | 235/92 T |
| 3,641,321 | 2/1972 | Tonne | 235/92 AC |
| 3,665,165 | 5/1972 | Strandberg | 235/92 T |

*Primary Examiner*—Joseph M. Thesz
*Attorney, Agent, or Firm*—Shenier & O'Connor

[57] ABSTRACT

A flexitime recorder for informing workers of the respective actual times they have worked during a day's work program of work time including a break time as well as of a set work time within the day's work time less any break work time whereby each worker is apprised of the amount of his overtime or undertime with respect to the set time in which a programming means generates a first signal representing the day's program of work time and including the break time represented by an absence of the first signal and a second output signal representing a set work time within the day's program and in which a first gate responsive to the first signal couples timing pulses from a timing pulse generator to individually operable switches associated with storage counters, each of which is associated with an individual worker and in which a second counter responsive to the output of the first gate and to the second output signal of the programmer passes timing pulses to an additional counter so as to indicate set time.

4 Claims, 3 Drawing Figures

FLEXITIME RECORDER

This is a division of application Ser. No. 491,068, filed July 23, 1974, now U.S. Pat. No. 3,974,362.

BACKGROUND OF THE INVENTION

The invention relates to a flexitime recording unit with a timing pulse generator with several generated time pulse counters which are connected to the time pulse generator and can be switched on and off therefrom with a program unit to interrupt the time pulse counting through the counters during given times especially during work stoppage.

Such a flexitime recording unit is known from the British Provisional Specification No. 1,284,462. The known flexitime recording unit possesses an electric main between the program unit and time pulse recorder to feed the time pulse recorder, which is disconnected by the program unit during work stoppage, so that no time pulses are being conducted to the counter during work stoppage. The result is that the indicated work stoppage will not be registered by the counters, so that the respective salaries of the employee can be thus computed.

The disadvantage of the known flexitime recording unit is that it does not furnish to the employee any information as to the set working time so that he must obtain this information from available lists or the like regarding his respective set work period for the respective pay period if on the basis of the actual working time indicated by the counter he wishes to ascertain the missed work time or overtime.

THE INVENTION

Proceeding from the known art, it is this invention's endeavor to inform the employee simply and continuously at his respective pay periods of his current work earnings, so that, in connection with the counting means, possible absences or overtime can be ascertained.

This problem is being solved by a flexitime recording unit which, according to the invention, provides next to the counter an additional counter to compute the set work period, to which the time pulses are being conducted by the program unit at indicated time intervals.

According to the invention, the program unit not only actuates the actual worker present time counter, as in the known time-recording unit, but also a set work time counter, so that the employee, by comparing the count of the set working time counter with the count of his "presence at work" counter, can immediately compute his missed time or overtime. Furthermore, there is an advantage to the invention in that a central guidance system of various counter-table units can operate in various locations of a factory as there is required only one respective change in the program unit, while heretofore with the known flexitime recorder a special list or the like was required for each counter group.

It has been proved to advantage when in the program unit guided by time pulse recorder the working and non-working days could be stored, thus obtaining a program for settling accounts for one week or also for a month.

Also to advantage is the fact that the entrance of the additional counter, i.e. of the set working time counter, can be connected with the flexitime recorder via a controlled gate.

A further advantage is that the program unit will have at least a first gate to screen the time pulse between the counters for time-presence and the time pulse generator, which in dependence of the working or non-working days is guidable to the earliest work start or the latest work stoppage, as well as to rest periods. By using gate circuits several sub-programs can be initiated, for instance, a sub-program for one single work-day and a superposed program for a whole work-week or even a month in a simple manner, whereby the possibility is retained to change single sub-programs independently from other sub-programs, which makes it possible for a flexible adaptation to the flexitime work plan wherever possible.

BRIEF DESCRIPTION OF THE DRAWINGS

Further features and details of the invention will be seen by the enclosed claims and/or description in connection with the drawings, as follows:

DETAILED DESCRIPTION OF FIRST EMBODIMENT

Figure 1:
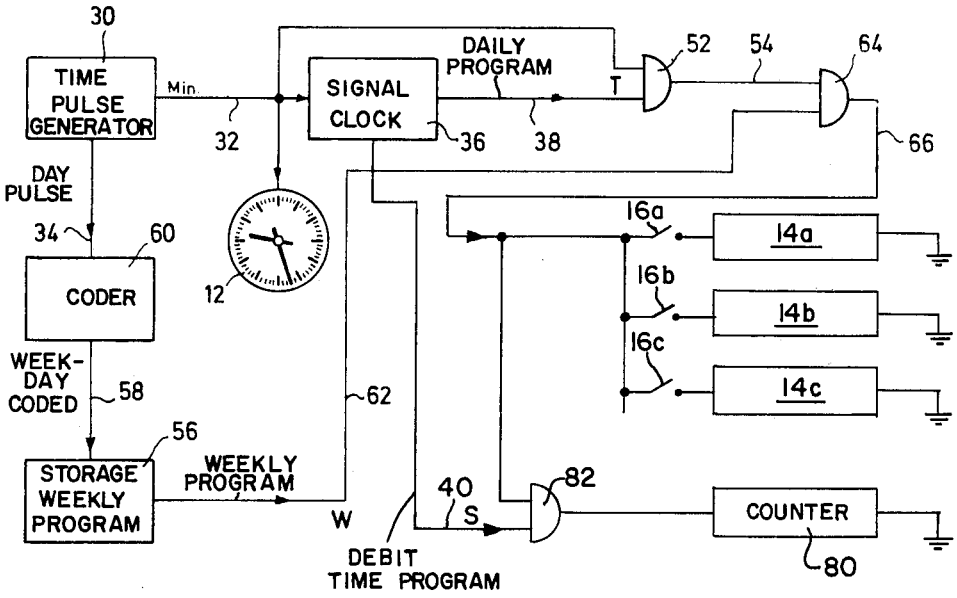
FIG. 1 is a block diagram of a preferred embodiment of flexitime recorder according to the invention.

In FIG. 1 of the flexitime recorder unit, a clock 12 is shown on which the employee can see the exact time, but it is to be understood that this clock is without significance in connection with the functioning of the flexitime recorder. Further, a number of counters **14*a*, 14*b* and an equal number of lock operated switches 16*a*, 16*b*** are provided, with each counter associated with a respective switch. The switches are lock operated switches with two contacts which, as will be further explained hereinafter, cooperate with the actuated or non-actuated switches. Each counter, for instance, can have a four-digit mechanism, a resetting button for the roller-counting mechanism and a plate, which permits consecutive numbering of the counters and inscription with the name or the respective worker.

The flexitime recorder contains further a time pulse generator 30 which consists of a crystal guided frequency generator. This generator transmits one pulse per minute, the so-called minute-pulse, over a conductor 32 and transmits one pulse in 24 hours, which hereinafter will be called the day pulse, to a conductor 34. The timing pulse generator contains a frequency divider, which is regulated by a crystal controlled oscillator circuit. At one stage of the frequency divider, the minute pulses are tapped off, while at the exit of the divider stages the day pulses are being tapped off.

Figure 3:
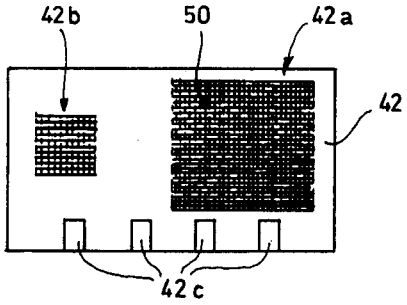
FIG. 3 is a program storage in form of a time punch-card according to FIG. 1.
Figure 2:
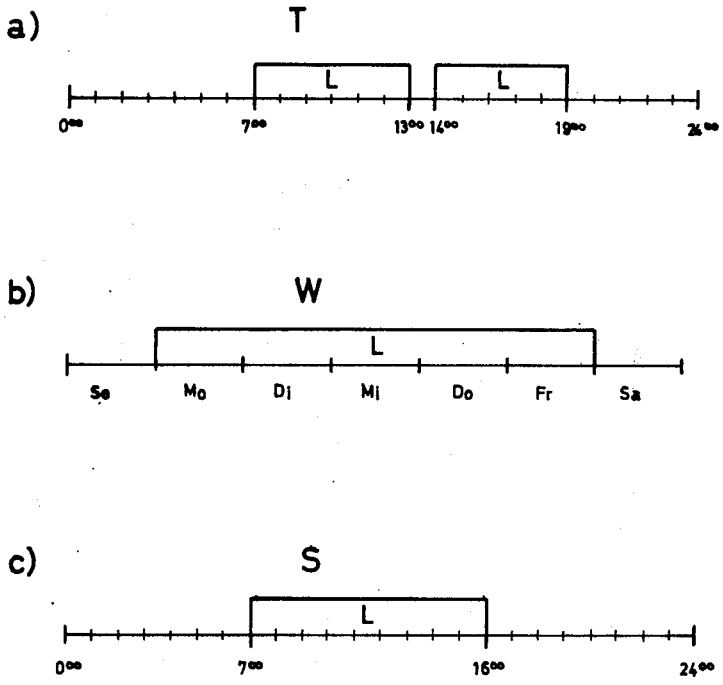
FIG. 2*a* illustrates an example of a day's time program used in the control system of the flexitime recorder.
FIG. 2*b* illustrates an example of a week's program used in the control system of the flexitime recorder.
FIG. 2*c* illustrates an example of a set-time program used in the control system of the flexitime recorder.

The conductor 32 leads to the input of a so-called signal clock 36, which forms part of the programming unit of the invention. The signal clock has two outputs on conductors 38 and 40, the day program T (see FIG. 2*a*) being tapped off on the conductor 38 and the set time program S (see FIG. 2*c*) being tapped off on conductor 40. To generate the programs, the programming unit 36 contains one or preferably more storage programs in form of time punch cards 42, one of which is shown in FIG. 3. This time punch card shows a conductor matrix 42a for the day program T and a further conductor matrix 42b for the set time program S, which can be tapped off via the circuit boards 42c of the time punch card of the signal clock, for the purpose of selecting of programs.

The conductor matrix 42a for the day program can have 24 columns and 60 lines or 60 columns and 24 lines if the state of the day program can change at any desired hour of day; if this is not the case, a conductor matrix with a smaller number of lines or columns corresponding to the number of hours in which a change may be desired could be sufficient. The signal clock 36 is so constructed that with the help of the conductor matrix 42a for the day program in steps of one minute it passes the minute pulses taken from conductor 32. In the conductor matrix 42a, the switching times of the times of change of the state of the day program T are defined in form of junctions, as junction 50, in hours and minutes, whereby a pulse is produced during the scanning of conductor matrix 42a. The pulse so produced drives a bistable element (not shown) into the signal clock 36, at which exit the day program T with the help of the exit conductor 38 is tapped off. Since matrix scanning circuits and bistable elements are known, it is not necessary to describe the construction of the signal clock 36 in detail, as any expert in the art can construct such a unit as described above.

It is understood that the day program can be divided in intervals other than one minute, but it will be necessary to scan at a frequency other than that corresponding to a 1 minute pulse. The scanning frequency must, of course, correspond to the subdivision of the program respectively to the program medium.

The conductor matrix 42b for the set time program S could be constructed in the same way as the conductor matrix 42a, but a subdivision coarser than a one minute subdivision should suffice, so that the conductor matrix can be made smaller. By scanning same, there are formed at these times a change of state, which pulse drives a further bistable element in the signal clock 36, in order to produce the states O and L of the set time program.

The conductor 38 with the day program T is connected to the one input of AND circuit 52, the other input of which is connected to the conductor 32 which carries the minute pulses. Thus, at the output conductor 54 of the AND circuit 52, there appear only those minute pulses which occur during the L state of the day program T.

In order to make allowance for the work-free days, the week program W (FIG. 2b) is established in a store 56. An input conductor 58 of the store 56 is connected via an encoding device 60 to the conductor 34; this encoder serves to produce on the input conductor 58 signals which are encoded on basis of the day impulses and associated with the different days of the week. The store 56 for the week program could again contain a program in form of a punch time card; it is suggested, however, to provide a storage program which can be re-programmed by hand, the simplest way is to provide a series of seven hand switches which can be scanned in store 56 in a 24-hour rhythm and whose position corresponds to the week program states associated with the different days of the week.

The output conductor 62 of the store 56 and the output conductor 54 of AND circuit 52 are connected to the inputs of a second AND circuit 64, so that minute pulses occur on its output conductor 66 only on working days and only when the day program is in the L state.

The counters 14a, 14b are connected via selector switches 16a, 16b to the output conductor 66 of the second AND circuit 64. As the output conductor 66 always shows minute pulses when the day program T and the week program W are in the state of L, the content or respectively the counter state of each counter 14a, 14b indicates therefore the true work period respectively during the presence of the respective worker, especially for a specific in-time schedule.

To determine the prescribed in-time, an additional counter 80 counts the set time to be worked, and represents an incremental operation. Counter 80's input is connected to conductors 66 and 40 via a third AND circuit 82. Counter 80 thus comprises, during the times when the set working time S is in state L, the minute pulses, conducted over output conductor 66 and adds up same, so that a set time program evolves with a respective counter state, as the set time program S — during the possible break times — takes a state O and thereby blocking the third AND circuit 82.

The disclosures of our Ser. Nos. 491,066 and 491,067, both filed July 29, 1974 and both co-pending with the parent application referred to hereinabove and respectively abandoned and issued as U.S. Pat. No. 3,922,531 are incorporated herein by reference.

We claim:

1. A flexitime recorder for informing workers of the respective actual times they have worked during a day's program of work time between a start time and a finish time and including a break time as well as of a set work time within the day's work time between said start time and said finish time less any said break time whereby each worker is apprised of the amount of his overtime or undertime with respect to said set time including in combination, timing pulse generating means for generating timing pulses, a plurality of first pulse actuated time storage counting means for counting said pulses, a plurality of respective switch means associated with said counting means, each of said switch means adapted to be actuated to render its associated counting means active to record the actual time a worker has worked during a day's work program, programming means for producing a first output signal representing said day's program of work time and including a break time represented by an absence of said first signal during said day's program and for producing a second output signal representing a set work time within said day's program, first coupling means responsive to said first output signal for coupling said timing pulses to said switch means as an input thereto, an additional counter, and second coupling means responsive to said second output signal and to the output of said first coupling means for coupling timing pulses to said additional counter to register therein said set work time less any break time falling within said day's program of work time and said set work time.

2. A flexitime recorder as in claim 1 including means responsive to said timing pulse generating means for storing a representation of working days and rest days.

3. A flexitime recorder as in claim 1 including means responsive to said timing pulse generating means for providing a third signal representing working days and rest days, and in which said first coupling means includes means responsive to said third signal, and in which said second coupling means is a gate.

4. A flexitime recorder as in claim 1 including means responsive to said timing pulse generating means for providing a third signal representing working days and rest days, said first coupling means including a first gate responsive to said timing means and said first output signal to produce a first gate output and a second gate responsive to said first gate output and said third signal.

* * * * *